US009851731B2

(12) United States Patent
Jain et al.

(10) Patent No.: US 9,851,731 B2
(45) Date of Patent: Dec. 26, 2017

(54) ULTRA LOW TEMPERATURE DRIFT BANDGAP REFERENCE WITH SINGLE POINT CALIBRATION TECHNIQUE

(71) Applicant: STMicroelectronics International N.V., Schiphol (NL)

(72) Inventors: Rajeev Jain, Greater Noida (IN); Chandrajit Debnath, Greater Noida (IN)

(73) Assignee: STMicroelectronics International N.V., Schiphol (NL)

( * ) Notice: Subject to any disclaimer, the term of this patent is extended or adjusted under 35 U.S.C. 154(b) by 29 days.

(21) Appl. No.: 14/530,448

(22) Filed: Oct. 31, 2014

(65) Prior Publication Data

US 2016/0124445 A1 May 5, 2016

(51) Int. Cl.

| | |
|---|---|
| ***G05F 1/46*** | (2006.01) |
| *G05F 3/16* | (2006.01) |
| *G05F 3/30* | (2006.01) |
| *G05F 3/26* | (2006.01) |

(52) U.S. Cl.

CPC ..... *G05F 1/468* (2013.01); *G05F 1/46* (2013.01); *G05F 3/16* (2013.01); *G05F 3/26* (2013.01); *G05F 3/30* (2013.01)

(58) Field of Classification Search

CPC . G05F 3/247; G05F 3/245; G05F 3/04; G05F 3/222; G05F 3/242; G05F 3/225; G05F 3/227; G05F 3/10; G05F 3/16; G05F 3/18; G05F 3/185; G05F 3/20; G05F 3/26; G05F 3/30; G05F 3/205; G05F 3/22; G05F 3/24; G05F 3/262; G05F 3/265; G05F 3/267; G05F 1/32

USPC ..... 323/312–317

See application file for complete search history.

(56) References Cited

U.S. PATENT DOCUMENTS

| | | | | |
|---|---|---|---|---|
| 5,852,360 | A * | 12/1998 | Levinson | G05F 3/245 323/314 |
| 6,346,802 | B2 * | 2/2002 | Lasalandra | 323/313 |
| 7,071,767 | B2 * | 7/2006 | Ou-yang | G05F 3/30 327/539 |
| 2009/0237150 | A1 * | 9/2009 | Tsai | G05F 3/30 327/539 |
| 2010/0073070 | A1 * | 3/2010 | Ng | G05F 3/30 327/513 |
| 2013/0249527 | A1 * | 9/2013 | Arnold | G05F 3/30 323/314 |
| 2013/0259091 | A1 * | 10/2013 | Chen | G01K 7/34 374/184 |

* cited by examiner

*Primary Examiner* — Timothy J Dole
*Assistant Examiner* — Bryan R Perez
(74) *Attorney, Agent, or Firm* — Seed Intellectual Property Law Group LLP

(57) ABSTRACT

A bandgap voltage generator includes a plurality of calibration transistors. A test circuit measures the bandgap reference voltage generated by the bandgap voltage generator and enables a subset of the calibration transistors to correct to the bandgap reference voltage.

16 Claims, 7 Drawing Sheets

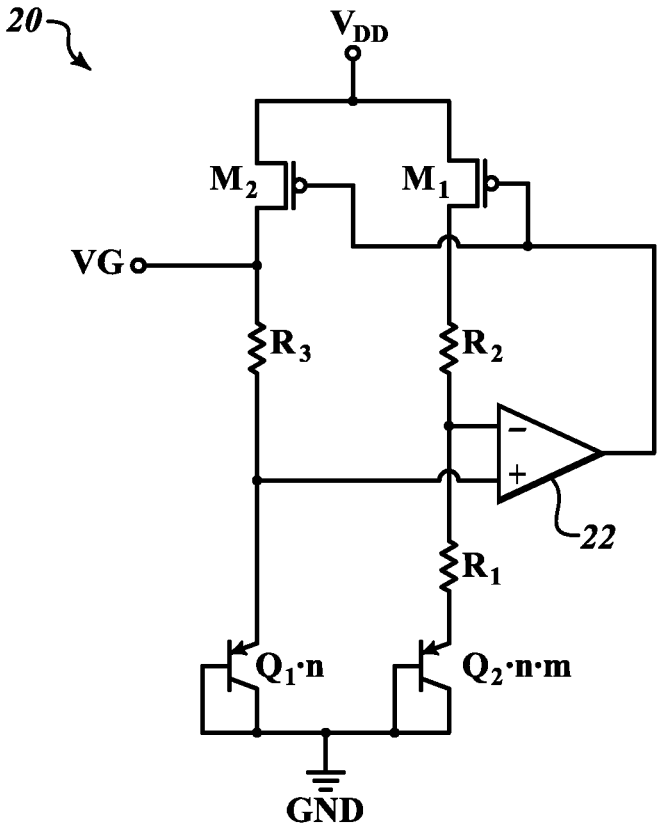
*FIG.1* *(Prior Art)*

ULTRA LOW TEMPERATURE DRIFT BANDGAP REFERENCE WITH SINGLE POINT CALIBRATION TECHNIQUE

BACKGROUND

Technical Field

The present disclosure relates to the field of bandgap circuits. The present disclosure relates more particularly to a low temperature drift bandgap circuit in integrated circuit dies.

Description of the Related Art

Integrated circuits often include reference voltage generators that generate various reference voltages. The reference voltages can be used in a large number of applications including accurate reading of memory cells, phase locked loops, voltage controlled oscillators, analog circuits, digital signal processing circuits, etc. It is beneficial for a reference voltage to have a particular don't value without variation data processing or environmental factors.

Bandgap voltage generators are often used to generate a reference voltage that can be used in any circuit applications. Bandgap voltage generators rely on the bandgap between the conduction band and the valence band of a semiconductor. Bandgap energy is the energy required for an electron to make the transition from the valence band of a semiconductor material to the conduction band of the semiconductor material. Each semiconductor material has a bandgap particular to that material. Because the bandgap energy is a physical characteristic of the semiconductor material it can be relied on as a reference voltage to which other voltages can be compared. Thus, bandgap voltage generators that generate a voltage based on the bandgap of a semiconductor material are commonly used in integrated circuits in which a reliable reference voltage is desired.

In spite of the constancy of the bandgap energy, bandgap voltage generators are imperfect. Bandgap voltage generators include circuitry such as transistors, resistors, and amplifiers that imperfectly reproduce the bandgap voltage. In particular, bandgap voltage generators may generate a voltage that varies unacceptably with changes in temperature. This is due to problems that can occur and processing of the integrated circuit die.

FIG. 1 is a schematic diagram of a known bandgap voltage generator 20 implemented in integrated circuit die with a monocrystalline silicon substrate. The bandgap voltage generator 20 generates a bandgap reference voltage VG based on the bandgap energy of monocrystalline silicon.

The bandgap voltage generator 20 includes a first group of p type bipolar transistors Q1. In the example FIG. 1, there are n transistors Q1 connected in parallel with each other. The emitters of the transistors Q1 are coupled to the non-inverting input of an operational amplifier 22. The collector and base terminals of the transistors Q1 are coupled to ground.

Bandgap voltage generator 20 further includes a second group of p type bipolar transistors Q2. An example of FIG. 1, there are n*m transistors Q2 each connected in parallel with each other. Thus, the number of transistors Q2 is the number of transistors Q1 multiplied by a number m. The emitters of the transistors Q2 are coupled to a resistor R1. The base and collector terminals of the transistors Q2 are connected to ground.

The resistor R1 is coupled between the inverting input of the amplifier 22 and a resistor R2. The resistor R2 is coupled between the inverting input of the amplifier 22 and the train terminal of a PMOS transistor M1. The gate of the transistor M1 is coupled to the output of the amplifier 22. The source of the transistor M1 is coupled to the supply voltage VDD.

A resistor R3 is coupled between the non-inverting input of the amplifier 22 and the train terminal of a PMOS transistor M2. The gate of the PMOS transistor is coupled to the output of the amplifier 22. The source of the PMOS transistor M2 is coupled to VDD.

The output of the bandgap voltage generator 20 is the node between the resistor R3 and the drain of the transistor M2. The output of the bandgap voltage generator generates the bandgap voltage VG based on the bandgap of the semiconductor substrate.

The reference voltage VG is based on the base emitter voltage Vbe1 of the transistors Q1 and the factor m. In particular, the voltage VG is given by the following relation:

$$VG = Vbe1 + \Delta Vbe * R2/R1 \quad (1)$$

$$= Vbe1 + (kb * T/q) * (\ln(m)) * R2/R1 \quad (2)$$

where kb is Boltzmann's constant, T is the absolute temperature in kelvin, q is the charge of an electron. This can be written in simpler terms as:

$$VG=VC+VP*K \quad (3)$$

where $$VC=Vbe1, \quad (4)$$

$$VP=\ln(m)*Kb*T/q \quad (5)$$

and $$K=R2/R1 \quad (6)$$

The term VC is complementary to absolute temperature (decreases with increases in absolute temperature). The term VP is proportional to absolute temperature (increases with increases in absolute temperature). K is the ratio of R2 and R1.

Designers of a bandgap voltage generator 20 according to FIG. 1 typically try to design the circuit so that the temperature complementary term VC and the temperature proportional term VP balance each other over a wide range of temperatures so that the generated bandgap voltage VG varies little with temperature.

FIGS. 2A and 2B illustrate two graphs showing the dependence of Vbe1 and ΔVbe on temperature. In the example of FIG. 2A, Vbe, which corresponds to VC in equation 3, varies by −2 mV per degree rise in Celsius, whereas ΔVbe, which corresponds to VP in equation 3, varies by 0.08 mV per degree Celsius. It can be seen that these two values of VC and VP do not cancel each other out well. However, in the graph of FIG. 2B the term VP is multiplied by the constant K which is the ratio of R2 to R1. When multiplied by the factor K, VP more closely cancels VC as can be seen in the curve labeled VG, which is the sum of the two and is thus the final bandgap voltage VG from equation 3. The generated bandgap voltage VG curve on the graph on FIG. 2B has only a mild curve with changing temperature. The constant K is selected to minimize the change in the generated bandgap voltage VG with temperature.

However, this solution suffers from some drawbacks. In particular, the absolute value of the base emitter voltage varies with the processing carried out on the semiconductor substrate during manufacture. Room temperature Vbe may vary slightly from one die to another based on processing.

Furthermore, the slope of Vbe will vary with processing so that the VP and VC do not cancel the same way on each die. Thus, the bandgap voltage may drift with temperature from die to die.

These drawbacks can be seen with respect to the graphs in FIG. 2C. The upper graph on FIG. 2C discloses several curves of Vbe for different processes carried out to make a die. The middle line, labeled VBE_BTYP, starts at about 730 mV at the low temperature of −40° and drops to about 420 mV at a high temperature of 120° C. The upper line, labeled VBE_BIMIN, starts at about 850 mV and decreases to about 480 mV. The lower line, labeled VBE_BIMAX starts at about 700 mV and decreases to about 400 mV with increasing temperature. This graph also shows that for different processes Vbe starts at different values at room temperature.

The lower graph of FIG. 2C shows three curves representing the slope of Vbe for different processes. As can be seen, the slopes of Vbe with respect to temperature (dV/dT) are different for the three different processes. Thus, a single design for a bandgap voltage generator will produce different bandgap voltages based on the process steps carried out in the manufacture of the semiconductor die.

BRIEF SUMMARY

One embodiment is an integrated circuit die having a tunable bandgap voltage generator including a plurality of calibration transistors. The tunable bandgap voltage generator can be calibrated before first use by testing the slope of Vbe and the starting point of Vbe and then enabling a certain number of the calibration transistors based on the test results. Thus, the bandgap voltage generator can be calibrated prior to use by the end customer.

In one embodiment, the bandgap voltage generator includes a calibration current path. The calibration transistors are placed in parallel in the calibration current path between the output of the bandgap voltage generator and ground. The bandgap voltage generator also includes a test circuit that tests Vbe and the slope of Vbe and then turns on select ones of the calibration transistors.

BRIEF DESCRIPTION OF THE SEVERAL VIEWS OF THE DRAWINGS

FIG. 1 is a block diagram of a known band voltage generator.

DETAILED DESCRIPTION

Figure 2A:
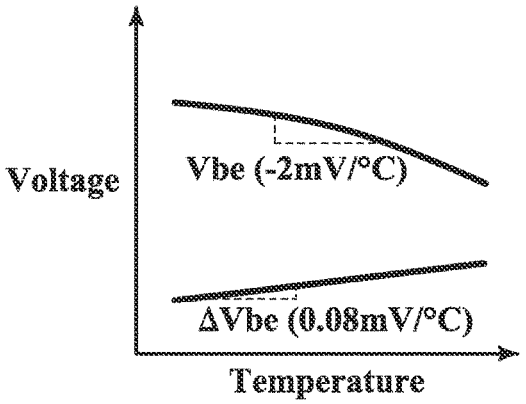
FIGS. 2A and 2B are graphs of base emitter voltage characteristics vs. temperature for a single die.
Figure 2B:
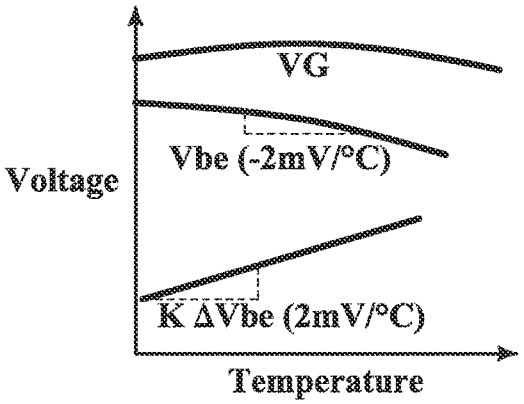
Figure 2C:
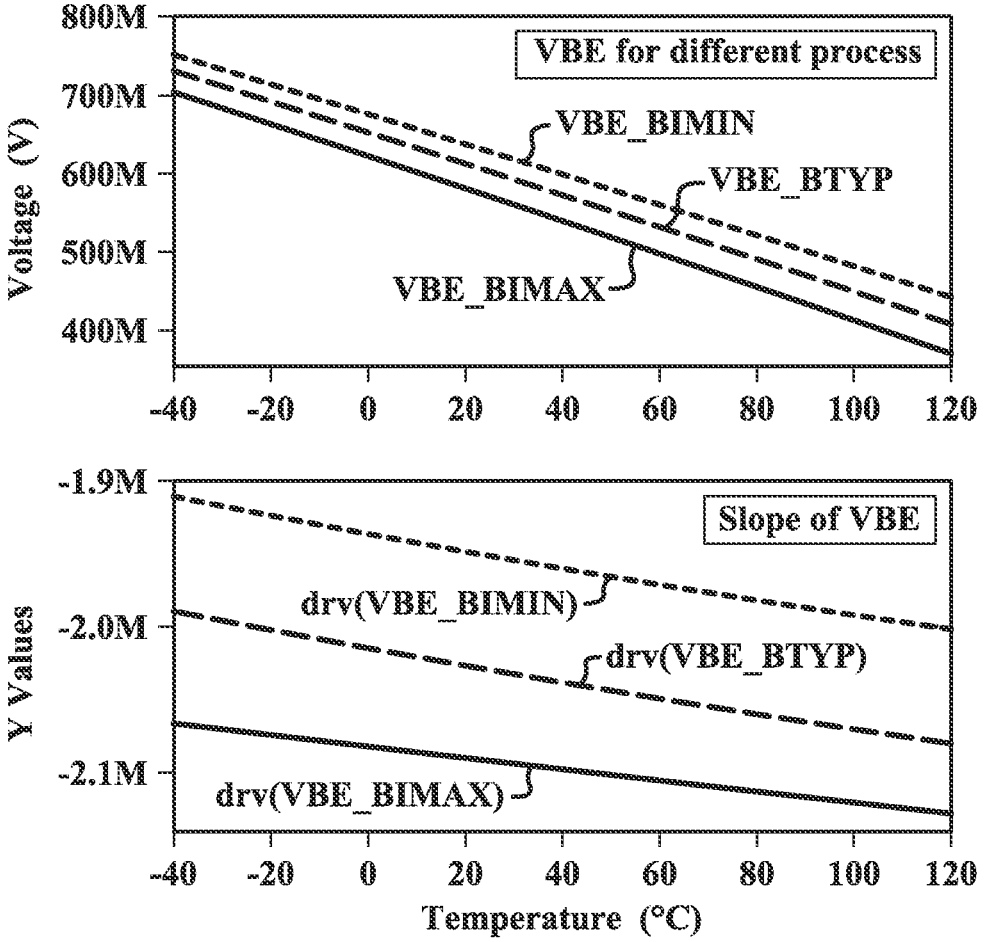
FIG. 2C is two graphs of base emitter voltage characteristics vs. temperature for different processes.
Figure 3:
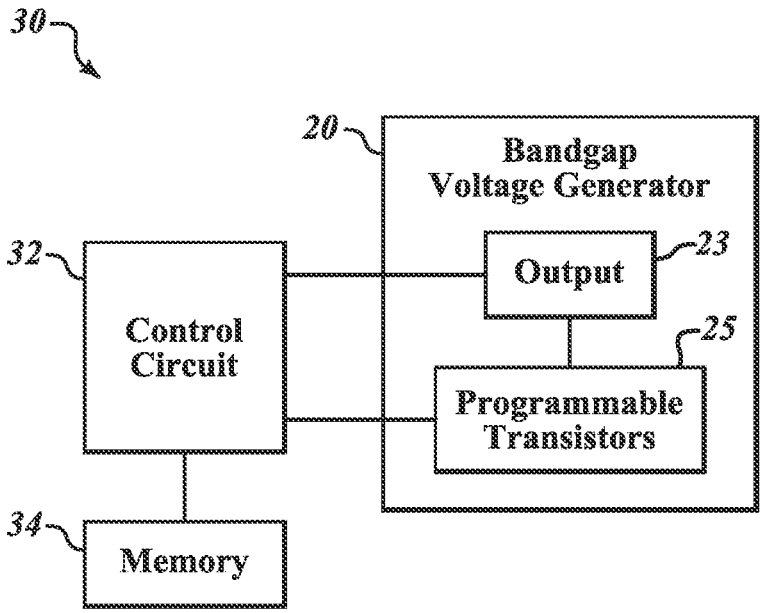
FIG. 3 is a block diagram of a bandgap voltage generator according to one embodiment.

FIG. 3 is a block diagram of an integrated circuit die 30 according to one embodiment. The integrated circuit die 30 includes a bandgap voltage generator 20. Bandgap voltage generator 20 includes an output 23 and a plurality of programmable transistors 25. The bandgap voltage generator 20 is coupled to a control circuit 32. A memory 34 is coupled to the control circuit 32.

The bandgap voltage generator 20 generates bandgap reference voltage based on the value of the bandgap of a semiconductor substrate of the integrated circuit die 30. Due to process variations, is possible that the bandgap voltage generator 20 will generate a bandgap voltage that varies too greatly with temperature, such that the reference voltage generated is unreliable.

In order to ensure that the bandgap voltage generator 20 generates a bandgap voltage that does not vary greatly with each different process, the bandgap voltage generator 20 includes a plurality of programmable transistors 25. The control circuit 32 measures the band voltage reference voltage generated by the bandgap voltage generator and compares the measured voltage to the data stored in the memory 34. The control circuit 32 retrieves a calibration code from the memory 34 corresponding to the measured bandgap voltage value. The control circuit 32 that enables one or more of the programmable transistors 25 based on the calibration code. In particular, the calibration code indicates the subset of the programmable transistors which should be enabled in order to calibrate the bandgap voltage generator so that the voltage it outputs varies little with temperature.

In one embodiment, the control circuit 32 applies a particular calibration code and then measures the bandgap voltage again. The control circuit 32 then compares the newly measure bandgap voltage to the data stored in the memory 34 and performs further calibration if further correction to the bandgap voltages needed. The control circuit 32 can continue this process until the bandgap voltage generated by the bandgap voltage generator is a satisfactory stable value over the expected range of operating temperatures.

Figure 4:
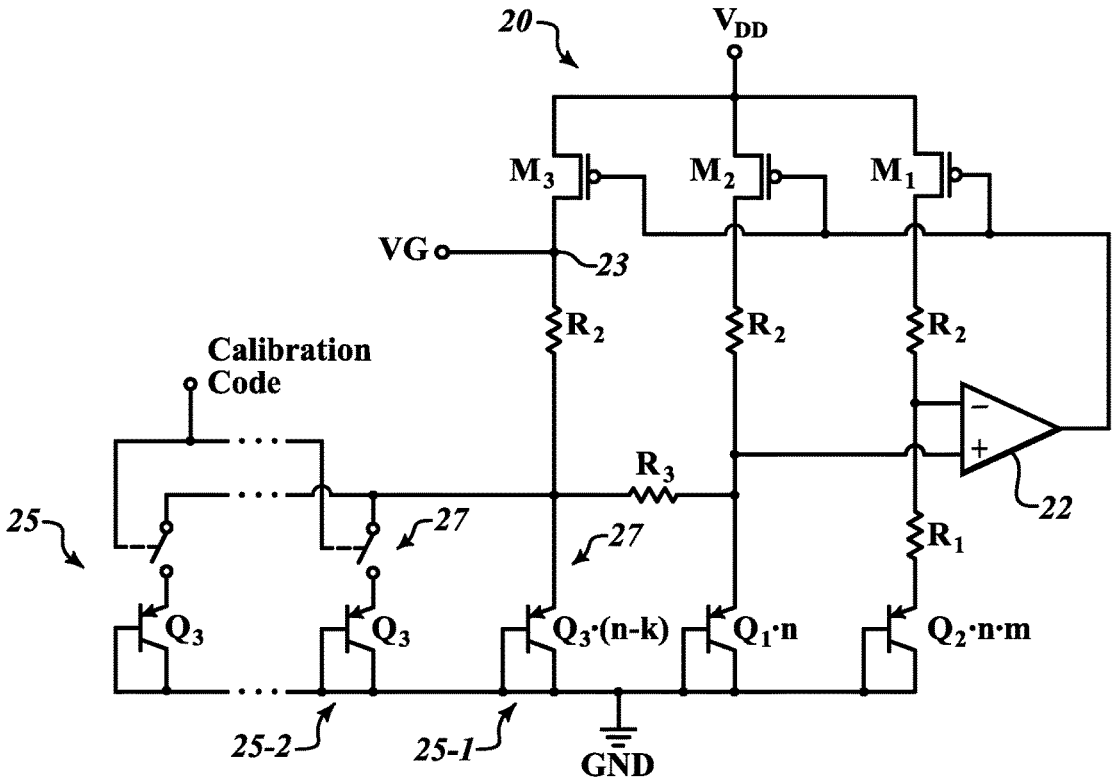
FIG. 4 is a schematic diagram of a bandgap voltage generator according to one embodiment.

FIG. 4 is a schematic diagram of a bandgap voltage generator 20 according to one embodiment. The bandgap voltage generator 20 includes a first group of n the type of bipolar transistors Q1 and a group of n*m transistors Q2. The bandgap voltage generator 20 also includes a group n-k the type of bipolar transistors Q3 and a group of programmable transistors 25, all labeled Q3. The transistors Q1-Q3 all have gate and collector terminals connected to ground. The emitters of the group of n Q1 transistors are connected to the non-inverting input of an amplifier 22. Each of the groups n, n*m, and n−k will usually have many transistors, but only one is shown in the figure.

The emitters of the group of n*m Q2 transistors are connected to a resistor R1. The emitters of the group of n−k Q3 transistors are connected to a resistor R2 and a resistor R3. The emitters of the programmable transistors Q3 are coupled to respective switches 27 that receive a calibration code. The switches 27 can couple or decouple the emitters of the Q3 transistors to the emitters of the group of n−k Q3 transistors. As shown in FIG. 4, some emitters start coupled to the resistors, with the switch 27 closed, as shown in the transistor labelled 25-1, while other transistors start with the switch 27 open, as shown with the transistors labelled 25-2. The resistor R1 is coupled between the emitters of the Q2 transistors and the inverting input of the amplifier 22. PMOS transistors M1-M3 each have their gate terminals coupled to the output of the amplifier 22 and there source terminals coupled to the high supply voltage VDD. A plurality of resistors R2 are each coupled to the respective drain terminals of the transistors M1-M3. The resistor R3 is coupled between the emitters of the group of n Q1 transistors and the emitters of the group of n−k Q3 transistors.

Because the base terminals of the Q1 and Q2 transistors are grounded, the voltage on the emitter terminals of the transistors Q1 and Q2 corresponds to the respective base emitter voltages Vbe1, Vbe2 of the bipolar transistors Q1, Q2.

The amplifier 22 outputs a signal corresponding to the difference between Vbe1 and Vbe2 as described previously. The output of the amplifier 22 goes to the gate terminals of the transistors M1-M3. Because the gate terminals of the transistors M1-M3 receive the same voltage from the amplifier 22, and because the sources of the transistors M1-M3 receive the same voltage VDD, the same current flows through each of the transistors M1-M3.

The voltage at the drain of the transistor M3 corresponds to the bandgap voltage but might not be the same as the semiconductor substrate. However, as described previously, due to process variations the bandgap reference voltage generated by the bandgap voltage generator 20 can both be offset with respect to the bandgap of the semiconductor substrate and can vary with temperature in a manner that takes it outside the design intolerances.

In order to ensure that the bandgap voltage generator 20 generates a bandgap voltage that is within tolerance, the control circuit 32 as described previously measures the bandgap voltage at room temperature. The control circuit 32 then refers to the data stored in the memory 34 to find a calibration code that corresponds to the measured voltage. The control circuit 32 then outputs the calibration code to the switches 27 coupled between the calibration transistors Q3 and the resistor R3. Based on a calibration code, some number of the calibration transistors Q3 will be coupled to the resistors R2 and R3. In some cases, it will be required to close more switches 27, while in other cases, it will be required to open more switches 27. This allows a portion of the current flowing through the transistor M3 to pass through those of the transistors Q3 that were enabled by the calibration code. This causes the voltage drop across the resistor R2 to change, thereby adjusting the bandgap voltage reference output by the bandgap voltage generator 20.

In this manner, the bandgap voltage generator 20 can be quickly and easily calibrated, either up or down, to output a bandgap reference voltage that is more accurate at room temperature and that varies less with changes in temperature.

In one embodiment, there are two thousand calibration transistors Q3. About half of these will start with the switch 27 closed and half with switch 27 open. The switch 27 can an MOS transistor whose state is easily changed by application of a voltage to the gate, or it can be a fuse or anti-fuse that will be blown or connected as needed to achieve the desired voltage. Of course, those of skill the art will understand that more or fewer calibration transistors Q3 can be used in light of the present disclosure. Also, different types of circuits can be used for the calibration transistors 25 or the switches 27.

Figure 5:
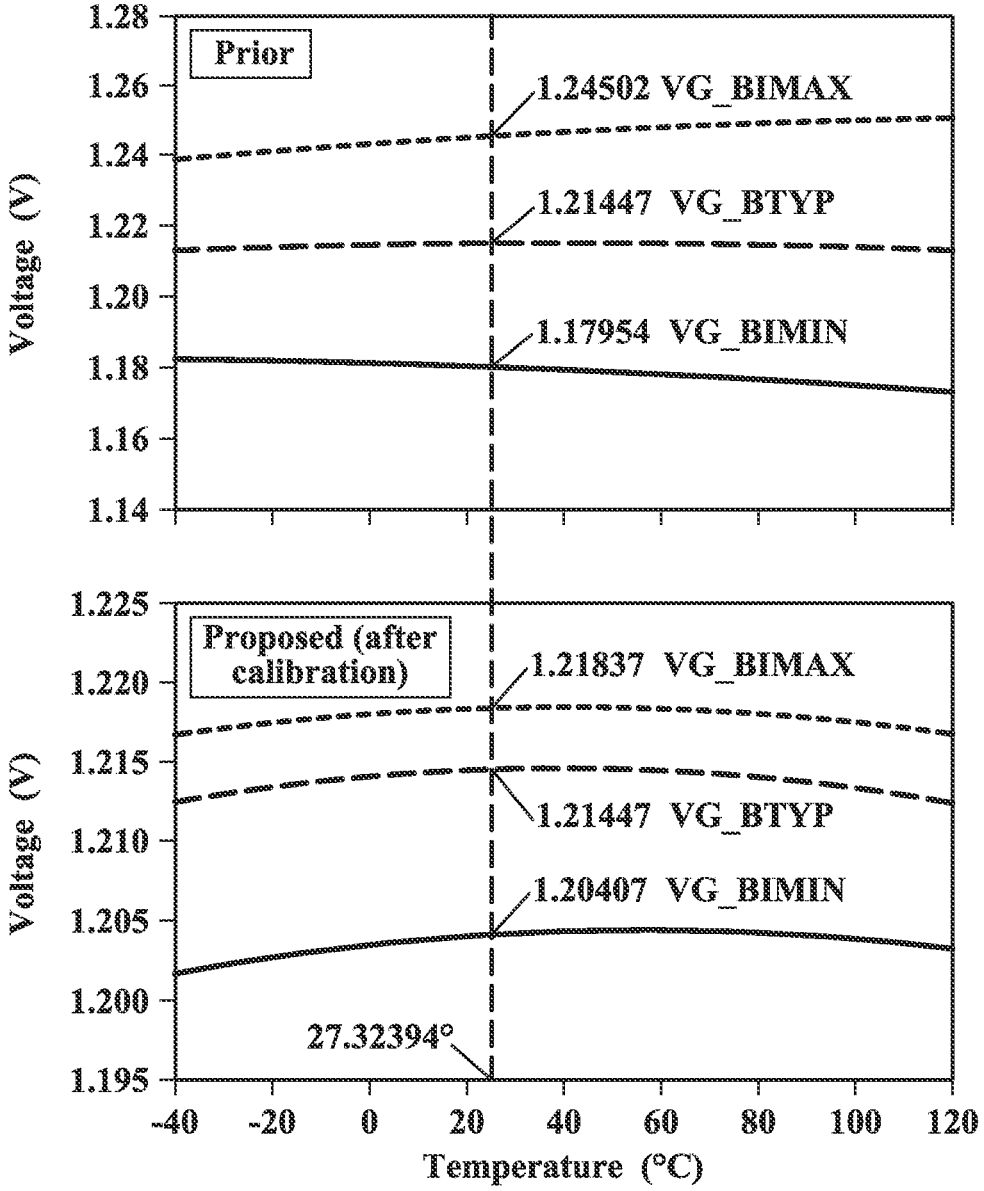
FIG. 5 is a series of graphs of bandgap voltages for different processes according to one embodiment.

FIG. 5 shows graphs of a plurality of bandgap voltages from three different circuits that included the calibration transistors and structure of FIG. 4. The upper graph includes three curves for the respective three bandgap reference voltages prior to calibration. VG_BIMIN is the lowest voltages output of the three circuits, at 1.17954 volts; VG_BTYP is in the middle value at 1.21447 volts and VG_BTMAX is at 1.24502 Volts. Only one of these is within the acceptable range of about 1.21 Volts, so calibration is carried out on the other two.

The lower graph shows the outputs of these same circuits with their bandgap reference voltages after calibration. In this particular example, the target is to have a bandgap voltage above 1.2 V but less than 1.22 V. Namely, it is desired that at room temperature the bandgap voltage be in the range of 1.21 V with a tolerance of 0.009 V. After calibration, the output of the circuit with the middle voltage is unchanged since no calibration was carried out. The circuit that output the highest bandgap voltage has now been calibrated to be lower, at 1.21837 Volts, while the lower of the voltages of the three has been raised, to be about 1.20407 volts. This is accomplished by connecting or disconnecting a selected number of the calibration 25 transistors to raise or lower the output of the bandgap voltage of that circuit. This is done by closing or opening the proper number of switches In the upper graph, the middle curve has a bandgap voltage of about 1.21 V at room temperature, the upper curve has a bandgap voltage of about 1.24 V at room temperature, and the lower curve has a bandgap voltage of about 1.18 V at room temperature. There is a range of about 0.06 V at room temperature between the three curves. The difference in the bandgap voltages is due to process variations. As can be seen, while the target bandgap voltage when the dies was made is 1.21 V, the actual voltage that was produced due to the process variations ranges from a high of 1.24 V to a low of 1.17 V. Accordingly, with the use of calibration, the bandgap voltage can be adjusted to closer to 1.21 V.

In the lower graph, after calibration, the middle curve has a bandgap voltage of about 1.214 volts, and was not calibrated since it was within the tolerance range. The upper curve has a bandgap voltage of about 1.218 V at room temperature, and the lower curve has a bandgap voltage of about 1.204 V at room temperature. Each of them is about 1.21 V., namely within the accepted tolerance of 0.009 V. of 1.21 V. Not only has the variance due to process of the bandgap voltage at room temperature decreased greatly after calibration, the changes in the bandgap voltages with temperature after calibration are also greatly reduced. Thus, a bandgap voltage generator 20 including the calibration transistors provides for much more accurate and stable bandgap reference voltage.

Figure 6:
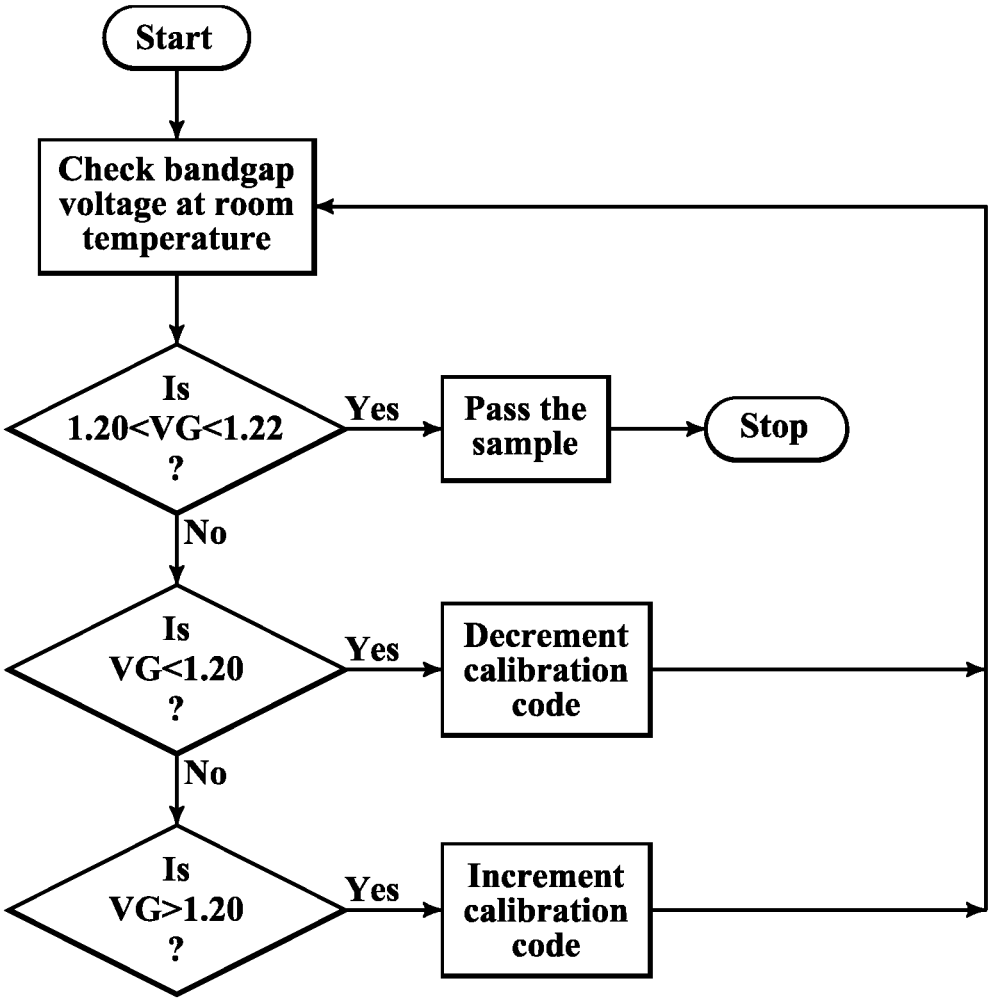
FIG. 6 is a flowchart of process for calibrating a bandgap voltage generator according to one embodiment.

FIG. 6 is a flowchart of a process for calibrating the bandgap reference voltage generated by a bandgap voltage generator 20 according to one embodiment. At 100 a control circuit 32 measures the bandgap reference voltage generated by a bandgap voltage generator 20 temperature. At 102, the control circuit checks to see if the bandgap reference voltage is between 1.20 and 1.22 V. If yes, then calibration is complete calibration is exited. If the bandgap reference voltage is not within the desired range, at 104 the control circuit 32 determines if the bandgap voltage is lower than 1.20 V. If the bandgap voltage is lower than 1.20 the calibration code is that you are of the transistors. At 106 the control circuit checks whether the bandgap reference voltage is greater than 1.20 V. If yes, then the calibration code is incremented and calibration returns to step 100. The calibration process continues incrementing or decrementing until the bandgap reference voltage falls within the desired range. Since the band gap voltage has been adjusted at room temperature, the entire curve has moved, as shown in FIG. 5 and will likely stay at about 1.21 V. for all operating temperatures.

Of course, with this invention, the bandgap voltage can be tuned to as many decimal points as desired, such as to within four or five decimal points.

In one alternative embodiment, it is also possible to calibrate the bandgap voltage for operation at a different temperature besides room temperature. According to this alternative embodiment, when the device is under test, the die is heated to an expected long-term operating temperature. This heating can take place by leaving the die on for a period of time so the die naturally reaches its operating temperature. Alternatively, the die can be heated with a heater near the test socket as part of the burn-in calibration test. Once the die has reached the expected operating temperature, which normally would be in the range of about 100° C.-110° C., the calibration sequence of FIG. 6 is repeated. Specifically, the bandgap voltage calibration steps, as set forth herein, and explained in FIG. 6, are carried out once again with the die at the full operating temperature. A new calibration factor is determined by the repeated tests as set forth in the flowchart of FIG. 6, this time at a full operating temperature. The correct number of calibration transistors needed to be switched into or out of the circuit is determined, and this is stored as calibration data in the memory 34, as shown in FIG. 3. Further, the indication is also stored that this is the correct calibration data when the circuit is at a full operating temperature.

The die is thereafter put into the commercial market and sold. Over the lifetime of the die, which may be several years, when the die is first placed in operation, the calibration data for room temperature operation is downloaded and used when the die is first turned on. The die has been properly calibrated to the desired bandgap voltage. After some period of time, the calibration data will be changed and the new data will be retrieved from the memory 34 representing the calibration data to be used when the die is at full operating temperature, for example 100° C. The time for changing the calibration data from room temperature operation to high temperature operation can be determined by any number of acceptable techniques. A first acceptable technique is merely on a timing basis. Namely, the expected time for the die to reach full operating temperature, which will often be in the range of half an hour, is determined. In some circuits it may be shorter or longer. Assume, in this example, that the time to reach the full operating temperature is expected to be about 30 minutes. Accordingly, in this example, after the die has been in operation for 30 minutes, as determined by clocks located in the control circuit 32, the calibration data for the high temperature operation will automatically be downloaded according to the software instructions stored in the memory 34 as guided by the control circuit 32. Thereafter, the high temperature calibration data will be loaded into the programmable transistors 25 and the die will then operate at the preferred bandgap voltage at the high temperature and will remain with this calibration data loaded until the die is turned off, after which time the process will repeat. Alternatively, a temperature sensor may be positioned adjacent to the die 30 which can sense the temperature and can download the proper calibration data based on the actual temperature as sensed. However, in most situations a temperature sensor will not be needed; it will be sufficient to download the new calibration data based on the time the die has been in operation, since this is generally a reliable indication of the expected temperature of the die.

While this alternative embodiment is not always used, if extremely fine tuning to an exact bandgap voltage over all operating temperatures is desired, it can be provided.

While various ranges, circuit designs, and configurations that the described those of skill the art will understand in light of the present disclosure that many other ranges, configurations, and circuit designs can be implemented in accordance with principles of the present disclosure. All such other ranges configurations and circuit designs fall within the scope of the present disclosure.

The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A bandgap voltage generator, comprising:

a first plurality of transistors each having a first terminal coupled to a positive power supply;

a second plurality of transistors each having a first terminal coupled to ground;

a first resistor having a first terminal coupled to a second terminal of a first transistor of the first plurality of transistors;

an output node of a bandgap reference voltage, the output node being between the first terminal of the first resistor and the second terminal of the first transistor of the first plurality of transistors;

a second resistor having a first terminal coupled directly to a second terminal of the first resistor and to a second terminal of a first transistor of the second plurality of transistors at a calibration junction, the calibration junction being in the electric path of the bandgap reference voltage, the second resistor having a second terminal coupled directly to a second terminal of a second transistor of the second plurality of transistors;

a third resistor having a first terminal coupled directly to a second terminal of a second transistor of the first plurality of transistors, and a second terminal coupled directly to the second terminal of the second transistor of the second plurality of transistors and to the second terminal of the second resistor;

a fourth resistor having a first terminal coupled to a second terminal of a third transistor of the first plurality of transistors;

an amplifier having a first terminal coupled to a second terminal of the fourth resistor, and a second terminal coupled to the second terminal of the second resistor;

a fifth resistor having a first terminal coupled to the first terminal of the amplifier, and a second terminal coupled to a second terminal of a third transistor of the second plurality of transistors;

a plurality of switches, each of the switches coupled to the calibration junction;

a plurality of calibration transistors having a current path selectively connected from the calibration junction to ground through the switches, the path being connected to draw current through the first resistor at its second terminal and away from the output node of the bandgap reference voltage; and a calibration input at the plurality of calibration transistors that receives a calibration signal enabling a first set of the plurality of the calibration transistors to draw current away from the output node of the bandgap reference and not enabling a second set of calibration transistors to prevent them from drawing current away from the output node of the bandgap reference.

2. The bandgap voltage generator of claim 1 wherein the second terminal of the first transistor of the first plurality of transistors is a drain terminal.

3. The bandgap voltage generator of claim 2 wherein a current passes from the first transistor of the first plurality of transistors through the one or more calibration transistors that have been enabled by the calibration signal.

4. The bandgap voltage generator of claim 3 wherein the current does not pass through the calibration transistors that have not been enabled by the calibration signal.

5. The bandgap voltage generator of claim 4 wherein an output terminal of the amplifier is coupled to a gate terminal of the first transistor of the first plurality of transistors.

6. The bandgap voltage generator of claim 5 wherein the second terminal of the second transistor of the second plurality of transistors is an emitter terminal that is coupled to the second terminal of the amplifier.

7. The bandgap voltage generator of claim 5 wherein the second terminal of the third transistor of the second plurality of transistors is an emitter terminal that is coupled to the first terminal of the amplifier.

8. The bandgap voltage generator of claim 6 wherein the second terminal of the first transistor of the second plurality of transistors is an emitter terminal, the second terminal of the second transistor of the second plurality of transistors is an emitter terminal, and the second resistor is coupled between the emitter terminal of the first transistor of the second plurality of transistors and the emitter terminal of the second transistor of the second plurality of transistors.

9. The bandgap voltage generator of claim 8 wherein the output terminal of the amplifier is coupled a gate terminal of the second transistor of the first plurality of transistors and to a gate terminal of the third transistor of the first plurality of transistors.

10. The bandgap voltage generator of claim 9 wherein the first terminal of each of the first plurality of transistors is a drain terminal.

11. The bandgap voltage generator of claim 10 wherein the first terminal of each of the second plurality of transistors is a collector terminal, and a gate terminal of each of the second plurality of transistors is coupled to ground.

12. A method, comprising:

coupling a first terminal of each of a first plurality of transistors to a positive power supply;

coupling a first terminal of each of a second plurality of transistors to ground;

coupling a first terminal of a first resistor to a second terminal of a first transistor of the first plurality of transistors, and a second terminal of the first resistor to a second terminal of a first transistor of the second plurality of transistors;

coupling a first terminal of a second resistor directly to the second terminal of the first transistor of the second plurality of transistors, and a second terminal of the second resistor directly to a second terminal of a second transistor of the second plurality of transistors;

coupling a first terminal of a third resistor directly to a second terminal of a second transistor of the first plurality of transistors, and a second terminal of the third resistor directly to the second terminal of the second transistor of the second plurality of transistors;

coupling a first terminal of a fourth resistor to a second terminal of a third transistor of the first plurality of transistors, and a second terminal of the third resistor to a first terminal of an amplifier;

coupling the second terminal of the second resistor to a second terminal of the amplifier;

coupling a first terminal of a fifth resistor to the second terminal of the forth resistor, and a second terminal of the fifth resistor to a second terminal of a third transistor of the second plurality of transistors;

generating a bandgap reference voltage at an output of a bandgap voltage generator at an output node between the second terminal of the first transistor of the first plurality of transistors and the first terminal of the first resistor;

coupling each of a plurality of switches to a calibration junction between the second terminal of the first resistor and the first terminal of the second resistor that is in the electric output path for the bandgap voltage;

drawing a first selected amount of current away from the calibration junction through one or more of the switches to vary the current drawn from the first resistor through one or more of the switches based on a number calibration transistors in a first set of calibration transistors that are enabled which are coupled to the junction;

making a first measurement of the bandgap reference voltage;

generating a first calibration signal based on the first measurement;

enabling a second set of calibration transistors that have a different number of transistors from the first set of calibration transistors; and drawing a second selected amount of current away from the junction through one or more of the switches based on the enabling of the second set of calibration transistors of the bandgap voltage generator by supplying the first calibration signal to the second set of calibration transistors.

13. The method of claim 12, comprising:

after supplying the first calibration signal to the bandgap voltage generator, making a second measurement of the bandgap reference voltage;

generating a second calibration signal based on the second measurement; and enabling a third set of calibration transistors by supplying the second calibration signal to the bandgap voltage generator.

14. The method of claim 13, comprising:

passing a second current from the second transistor of the first plurality of transistors to the third transistor of the first plurality of transistors;

amplifying a signal from the second transistor of the first plurality of transistors; and passing the amplified signal to a gate terminal of the first transistor of the first plurality of transistors.

15. The method of claim 12, comprising:

after supplying the first calibration signal to the bandgap voltage generator, making a second measurement of the bandgap reference voltage; and ending a calibration operation if the bandgap reference voltage is within a selected range.

16. The method of claim 12, comprising passing a current from the first transistor of the first plurality of transistors to the first set of calibration transistors upon enabling the first set of calibration transistors, a drain terminal of the first transistor of the first plurality of transistors being coupled to the output of the bandgap voltage generator.

* * * * *